US011447719B2

(12) United States Patent
Staley et al.

(10) Patent No.: US 11,447,719 B2
(45) Date of Patent: Sep. 20, 2022

(54) CANDLE WICK ASSEMBLIES WITH MULTIPLE OPPOSITELY CURLABLE CANDLE WICKS AND CANDLES INCLUDING THE SAME

(71) Applicant: FIL-TEC HOLDINGS, INC., Cavetown, MD (US)

(72) Inventors: Kyle R. Staley, Waynesboro, PA (US); Andrew L. Wallech, Falling Waters, WV (US); Lesa F. Bowers, Hagerstown, MD (US); Charles H. Rockwell, Boonsboro, MD (US); Amir Yaraghi, Fairplay, MD (US); Vincent E. Schoeck, Jr., Hagerstown, MD (US); Vincent E. Schoeck, V, Hagerstown, MD (US)

(73) Assignee: FIL-TEC HOLDINGS, INC., Cavetown, MD (US)

( * ) Notice: Subject to any disclaimer, the term of this patent is extended or adjusted under 35 U.S.C. 154(b) by 141 days.

(21) Appl. No.: 16/704,508

(22) Filed: Dec. 5, 2019

(65) Prior Publication Data

US 2021/0171861 A1 Jun. 10, 2021

(51) Int. Cl.
*C11C 5/00* (2006.01)

(52) U.S. Cl.
CPC ..... *C11C 5/006* (2013.01)

(58) Field of Classification Search
CPC ..... C11C 5/006
See application file for complete search history.

(56) References Cited

U.S. PATENT DOCUMENTS 21,890 A * 10/1858 Leslie ..... F21V 37/00 431/298
31,045 A * 1/1861 Weeden ..... F21V 37/00 431/298
243,272 A * 6/1881 Joly ..... C11C 5/002 431/288
2,121,293 A * 6/1938 Heil ..... F21V 37/0025 431/325
2,291,067 A * 7/1942 Atkins ..... A47G 33/00 431/291

(Continued)

FOREIGN PATENT DOCUMENTS

EP 3572488 11/2019
GB 1058844 A * 2/1967 ..... C11C 5/006

(Continued)

OTHER PUBLICATIONS

EP Appln. No. 20211864.2, Extended European Search Report (EESR), dated Jun. 1, 2021.

*Primary Examiner* — Jorge A Pereiro
*Assistant Examiner* — Logan P Jones
(74) *Attorney, Agent, or Firm* — Nixon & Vanderhye P.C.

(57) ABSTRACT

Multiple candle wicks are provided that may be placed into a candle wax (paraffin) body such that the wicks when lit curl in a direction opposite to the curl direction of an adjacent wick, e.g., adjacent ones of each wick curling in an opposite direction relative to a bisecting midplane of the candle. By such oppositely curling wicks when lit, therefore, the wax pool diameter may thereby be increased which in turn increases the amount of liberated scents from the candle body.

10 Claims, 3 Drawing Sheets

(56) References Cited

U.S. PATENT DOCUMENTS

| | | | | |
|---|---|---|---|---|
| 2,818,718 | A * | 1/1958 | Roberts | F21V 37/0095 431/291 |
| 3,428,409 | A | 2/1969 | Summers | |
| 3,940,233 | A * | 2/1976 | Fox | C11C 5/006 431/325 |
| 6,699,034 | B2 | 3/2004 | Schoeck | |
| 6,758,667 | B2 | 7/2004 | Wilson | |
| 2003/0013060 | A1* | 1/2003 | Schoeck | F23D 3/16 431/288 |
| 2003/0211437 | A1* | 11/2003 | Wilson | F23D 3/36 431/325 |
| 2011/0294081 | A1* | 12/2011 | McLaren | C11C 5/008 431/291 |
| 2018/0355279 | A1 | 12/2018 | Staley et al. | |
| 2021/0102143 | A1* | 4/2021 | Staley | C11C 5/006 |

FOREIGN PATENT DOCUMENTS

| | | | |
|---|---|---|---|
| KR | 200352940 | Y1 * | 6/2004 |
| WO | WO 02/088595 | | 11/2002 |

* cited by examiner

CANDLE WICK ASSEMBLIES WITH MULTIPLE OPPOSITELY CURLABLE CANDLE WICKS AND CANDLES INCLUDING THE SAME

CROSS-REFERENCE TO RELATED APPLICATION

This application may be deemed to be related to commonly owned U.S. patent application Ser. No. 15/985,991 filed on May 22, 2018 (now U.S. Pat. No. 11,021,677), and U.S. patent application Ser. No. 16/704,488 filed on Dec. 5, 2019 (now U.S. Pat. No. 10,975,329), the entire content of each such application being expressly incorporated hereinto by reference.

FIELD

The embodiments disclosed herein relate generally to candle wick assemblies having multiple candle wicks which curl oppositely to one another when lit and candles which include such wick assemblies.

BACKGROUND

Candles employing a wick have been in existence for many centuries. A typical candle has a single wick, or multitude of wicks, that extend(s) longitudinally through the body of the candle. Single wicks are usually centrally disposed in the candle body. The combustible candle body is typically a thermoplastic blend of petroleum (paraffin) wax, mineral (montan) wax, synthetic wax (polyethylene or Fischer-Tropsch (FT) waxes) or natural waxes (vegetable or animal waxes). Clear candle waxes, known as gel candles, have diverse decorating potential. These gel candles are made from mineral oil and special resins. Natural, plant based soybean wax is gaining popularity as a cost competitive, environmental or "green" wax derived from renewable resources. Various additives used to modify the candle hardness, color, burn rate and aroma are well known in the trade and include, for example, stearic acid, UV inhibitors, polyethylene, scent oils and color pigments. Upon lighting a candle wick, the heat melts the wax which then travels up the wick by capillary action and is vaporized. Performance requirements of a wick in a candle include the ability to create and maintain the desired burn rate, the ability to create and maintain the desired wax pool and, if specified or required, the ability to bend or curl to maintain the proper wick height (referred to in the trade as "self-trimming"). In addition to these performance requirements, it is important that the finished wick be stable and not subject to size fluctuation when tension is applied to the wick during the candle making or wick pre-waxing process. The ability of the wick to be self-supporting may be preferred, or even required, in certain candle types or candle manufacturing processes, e.g., so-called poured candle constructions where the molten wax fuel is poured into a mold around a pre-positioned and pre-waxed wick and thereafter allowed to solidify.

One performance characteristic of scented candles that may be employed for environmental scent freshening or aroma therapy is the size of the liquid pool of wax fuel that forms on the top of the candle. In general, manufacturers of scented candles prefer to have a large liquid pool of wax fuel as this increases the scent released into the ambient environment. At the same time, however, flame height cannot be too high or the candle flame will then emit undesirable soot that can mar the appearance of the candle and candle holder and nearby surfaces, i.e., by visible smoke being emitted from the candle flame and being deposited as soot on the candle holder and into the environment and/or by the presence of undesirable black carbon droppings that are visible in the liquid wax pool. These carbon deposits, can cause secondary ignition, a safety hazard near the end of the candle life. A single conventional wick large enough to produce the necessary heat to form the desired size liquid wax pool often results in an unreasonably high flame, carbon deposits and excess sooting all of which are undesirable and some of which are unsafe.

It is known that providing multiple spaced-apart wicks will increase the size of the liquid wax pool while maintaining several smaller flames. However, increasing the number of wicks will in turn increase manufacturing costs (and hence increase the cost of the finished candle product) since multiple wick insertions must be made into the solid wax fuel during production. Additionally, conventional multiple wick candles produce a much less consistent burn environment within the candle. Having two or more independent flames causes considerable air turbulence which changes as the wax level in the candle container drops over time. This air turbulence within the candle container can cause the flame height to fluctuate significantly from under ¼" to over 1.5" over the life of the candle.

It would therefore be highly desirable if a candle wick assembly could be provided having multiple individual wicks that are capable of achieving a further increase in the liquid wax pool size than that which has conventionally been available. It is towards fulfilling such a need that the embodiments disclosed herein are directed.

SUMMARY

In general, the embodiments disclosed herein provide multiple candle wicks that may be placed into a candle wax (paraffin) body such that the wicks when lit curl in a direction opposite to the curl direction of an adjacent wick. By such oppositely curling wicks when lit, therefore, the wax pool diameter may thereby be increased which in turn increases the amount of liberated scents from the candle body.

In some preferred embodiments, the multiple candle wicks as disclosed herein will include a wick construction having at least one pair of substantially parallel elongate candle wicks which are laterally separated from one another, and a ladder filament connecting the pair of candle wicks. The ladder filament extends back and forth between the candle wicks (e.g., at substantially 90° relative to the elongate axes of the wicks) so as to establish respective crossing portions that are spaced apart from one another along a lengthwise direction of the construction. The construction of each wick is such that a curl direction can be predetermined. As such, the wicks are positioned adjacent one another in such a manner so that when connected by the ladder filament and placed in a candle wick body, the wicks curl in opposite directions relative to one another (preferably opposite directions of a midplane of the candle wick body).

The candle wicks provided in the wick assemblies described herein are preferably knitted wicks such as those described in U.S. Pat. No. 6,699,034 (the entire contents of which are expressly incorporated hereinto by reference). Such knit candle wicks will also preferably include an inserted elongate stiffening element to assist in maintaining the wicks of the wick assembly in an upright position during candle manufacturing. The preferred knit candle wicks will therefore have a weft side and a warp side with the elongate stiffening element being inserted therebetween by weft-inserted yarns.

According to certain embodiments, the ladder filament may be a thermoplastic monofilament which includes crossing portions are substantially orthogonal to respective elongate axes of the candle wicks. The candle wicks may include elongate stiffening elements, such as thermoplastic monofilaments and spun yarns of natural fibers coated with a thermoplastic material, to impart self-supporting characteristics to the candle wicks.

The candle wick construction may be inserted into a wax body so as to form a candle such that an upper portion of each wick extends above the top surface of the candle body. When lit, therefore, the candle wicks will form a molten wax pool at the top surface of the wax body and provide fuel to the wicks to maintain the candle flame. The diameter of the wax pool will therefore be increased by virtue of the multiple wicks curling the adjacent wicks curling in opposite orthogonal directions relative to a bisecting midplane of the candle. According to some embodiments, at least three wicks are provided, adjacent ones of each wick curling in an opposite direction relative to the bisecting midplane of the candle. Certain embodiments will include at least four wicks, wherein adjacent ones of the wicks curls in an opposite orthogonal direction relative to the bisecting midplane of the candle. The multiple wicks may be positioned in alignment with the bisecting midplane of the candle.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

A. Definitions

Figure 1:
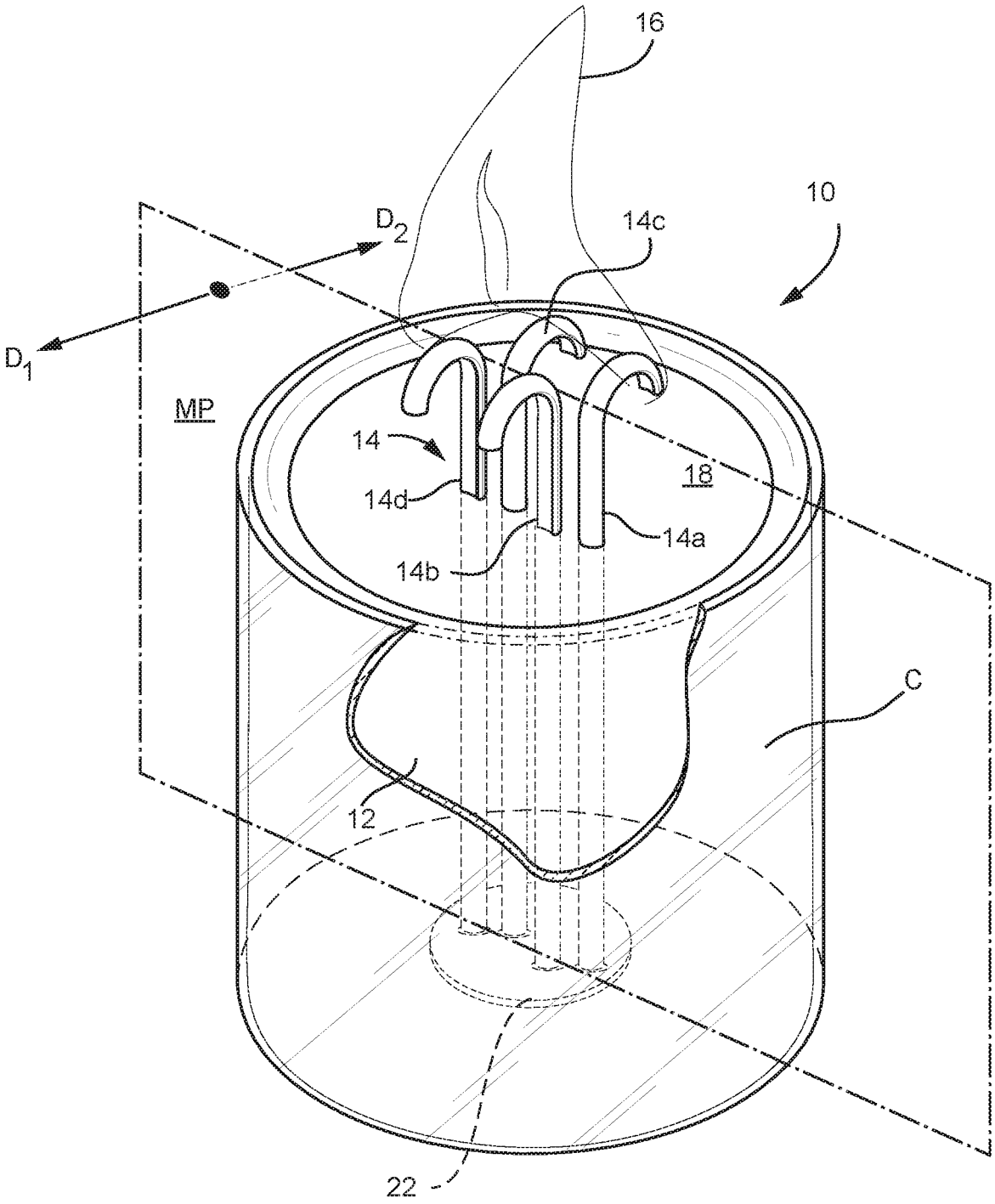
FIG. 1 is a perspective view of a burning candle which embodies a multiple candle wick assembly in accordance with an embodiment of the invention.

As used herein and in the accompanying claims, the terms below are intended to have the following definitions:

"Filament" means a fibrous strand of extreme or indefinite length.

"Fiber" means a fibrous strand of definite length, such as a staple fiber.

"Yarn" means a collection of numerous filaments or fibers which may or may not be textured, spun, twisted or laid together.

"Knit" or "knitted" refers to the forming of loops of yarn with the aid of thin, pointed needles or shafts. As new loops are formed, they are drawn through those previously shaped. This inter-looping and the continued formation of new loops produces a knit material.

"Braid" or "braided" refers to a relatively narrow textile band or cord formed by plaiting or intertwining three or more strands of yarn diagonally relative to the production axis of the band or cord so as to create a regular diagonal pattern down its length.

"Warp knit" or "warp knitting" refers to a type of knitting in which the warp yarns generally run lengthwise in the knit fabric material.

"Warp yarn" refers to the yarn or yarns that form the interlocking loops and generally run lengthwise in the machine direction of the knit fabric material.

"Woven" means a fabric structure formed by weaving or interlacing warp-wise and weft-wise yarns or filaments of indefinite length at substantially right angles to one another.

"Warp-wise" and "weft-wise" denote the general orientations of yarns as being generally in the machine direction and cross-machine direction, respectively.

"Laid-in yarn" refers to the yarn or yarns that are laid-in with the warp yarns and do not form part of the fabric, e.g., do not form interlocking loops such that the warp yarns are knit around such laid-in yarns.

"Wick curl" is the arc from the top of the wax pool to the terminal end of the wick that is formed by the wick after it is burned in the candle, expressed in degrees. Preferably, the wicks as disclosed herein exhibit a wick curl having no more than about 90° (i.e., so that the terminal end of the wick does not extend substantially beyond a horizontal plane relative to a vertical axis of the candle in which the wick is formed).

"Self-trimming" is the regulation of the wick height and length, to an acceptable size so that it burns clean with little carbon build-up or smoking, by the candle burning process. A certain amount of "wick curl" is required for a wick to be "self-trimming".

"Self-supporting" refers to a property of a wick whereby a finite length of the wick remains generally oriented along the wick's elongate axis when held upright without lateral support.

"Stable wax pool" means a wax pool that has attained a maximum diameter which does not increase over time during candle burning.

"Uniform diameter wax pool" refers to a wax pool that has a substantially uniform circular diameter.

"Burn rate" is the amount of wax fuel, expressed by weight, consumed over a period of time, e.g. grams of wax fuel per hour (gm/hr).

"Flexural stiffness" or "bending stiffness" is the property of an elongate yarn or filament to bend under applied force with sufficient memory to return to its original elongate state. Yarns and fibers having relatively high flexural or bending stiffness will also typically possess a relatively high Young's modulus. Those fiber elements which require a relatively high flexural or bending stiffness will thus typically possess a Young's modulus of between about 0.5 to about 10 MPa, e.g., between about 0.5 to about 5.0 MPa or between about 1.0 to about 3.0 MPa.

B. Description of Preferred Exemplary Embodiments

Accompanying FIG. 1 depicts an exemplary burning candle 10 which includes a body 12 formed of a solid, combustible candle wax material provided in a container C formed of any suitable material, e.g., glass, metal, ceramic or the like. The candle wax material forming the body 12 of the candle 10 is provided with a wick assembly 14 comprised of a number of adjacently positioned wicks 14*a*-14*d* aligned along a bisecting midplane MP of the body 12. The flame 16 burning the wicks 14*a*-14*d* at the top end of the candle body 12 creates a generally circularly shaped (as viewed from above) molten wax pool 18 which serves as a reservoir of fuel to be supplied by the wicks 14*a*-14*d* to allow combustion to continue.

As is shown in FIG. 1, each of the wicks 14*a*-14*d* exhibits a wick curl that is opposite an adjacent wick. That is, each of the terminal end portions of the wicks 14*a*-14*d* is arced in a direction relative to the wick's respective elongate axis $A_1$-$A_4$ so that a portion thereof extends generally at a right angle (e.g., about 90°) relative to such elongate axis $A_1$-$A_4$ (see FIG. 2). In the embodiment depicted adjacent ones of the wicks 14*a*-14*d* will alternately be directed laterally in either first or second opposite directions $D_1$, $D_2$ orthogonal to such midplane MP. As a result, the terminal ends of the wicks 14*a*-14*d* are generally positioned at the edge of the flame 16 thereby allowing the terminal end portion of the wicks 14*a*-14*d* to themselves to be combusted. As can be appreciated, and as was discussed above, such controlled wick curl and wick combustion allows the wicks 14*a*-14*d* to be self-trimming. Moreover the alternately opposite curl directions of the wicks 14*a*-14*d* will serve to increase the diameter of the wax pool 18.

The wick assembly 14 containing the wicks 14*a*-14*d* may be embedded in the wax body 12 of the candle 10. The wick assembly 14 may also include an anchor tab 22 so as to anchor each of the wicks 14*a*-14*b* into wax body 12 of the candle 10.

Figure 2:
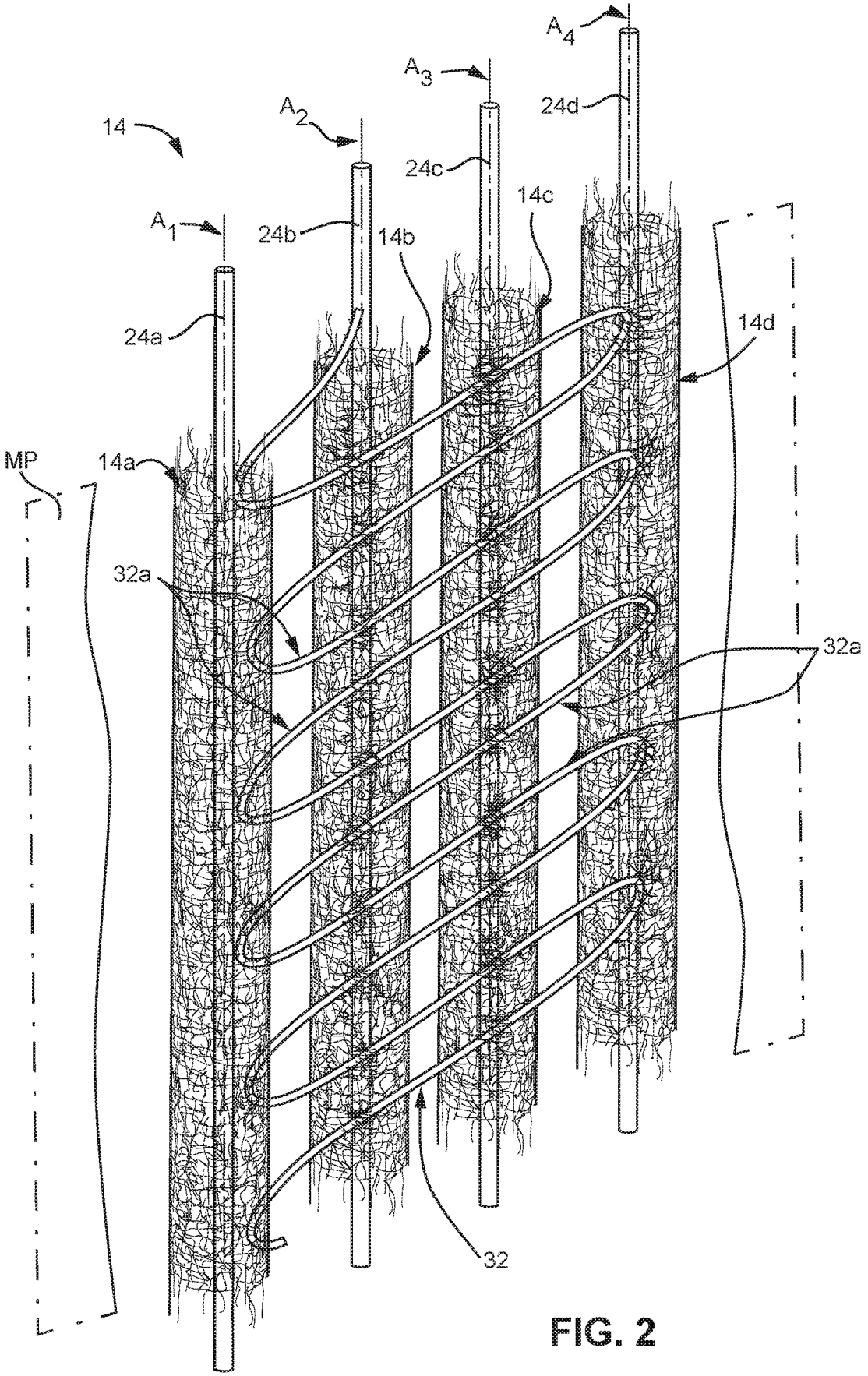
FIG. 2 is an enlarged schematic perspective view of a multiple candle wick assembly in accordance with an embodiment of this invention.

As shown more specifically in FIG. 2, a multiple wick assembly 14 includes individual wicks 14*a*-14*d* that are cross-connected to one another by a ladder filament 32 so as to be disposed in the midplane MP. In order to enhance the self-supporting characteristic of the individual wicks 14*a*-14*d*, a respective stiffener filament 24*a*-24*d* may be provided as part of the wick structure.

The wicks 14*a*-14*d* may be formed of a conventional candle wick material, e.g., yarns comprised of cotton, rayon, linen, hemp, bamboo and/or other cellulosic fibers. The stiffener elements 24*a*-24*d*, on the other hand may be a monofilament or spun yarn formed of any suitable synthetic or natural fibrous material provided it imparts the requisite stiffening properties to the wicks 14*a*-14*d* so the wicks will substantially not bend under gravitational force (e.g., a sufficient stiffness whereby a length of each wick 14*a*-14*d* of about 6 inches or less will remain substantially horizontal when held in a horizontal plane at an end thereof). Thus, stiffener elements 24*a*-24*d* having a flexural stiffness (Young's modulus) of between about 0.5 to about 10 MPa can satisfactorily be employed in the practice of the embodiments of this invention.

One suitable class of materials from which the stiffener elements 24*a*-24*d* may be made include thermoplastics, e.g., polyolefins such as polypropylene or polyethylene, nylons, polyesters and the like. In some embodiments, the stiffener elements 24*a*-24*d* are monofilaments of polypropylene as such a material provides the desired stiffness in order to promote self-supporting capabilities to the wicks 14*a*-14*d* so as to be capable of extending upright along the axes $A_1$-$A_4$, respectively, without the aid of external support. In addition, the monofilaments forming the stiffener elements 24*a*-24*d* will exhibit a required melting temperature of greater than the melt temperature of the wax body 12, e.g., greater than about 220° F. (105° C.). One preferred form of wick stiffener elements 24*a*-24*d* can therefore be polypropylene monofilaments having a diameter from about 0.01 inch to about 0.05 inch.

The stiffener elements 24*a*-24*d* may also be formed of a multifilamentary yarn of spun natural fibers, such as cotton or rayon, provided with a coating material to impart stiffness to the yarn. Suitable thermoplastic coating materials such as polyolefins, nylons, polyesters, polyurethanes and the like may be employed for the purpose of imparting stiffness to the natural fibers of the multifilamentary yarn so that the elements 24*a*-24*d* will exhibit the desired flexural stiffness as discussed previously. A finished multifilamentary yarn of spun natural fibers coated with a suitable thermoplastic coating material can be between about 1400 to about 3600 denier.

Figure 3:
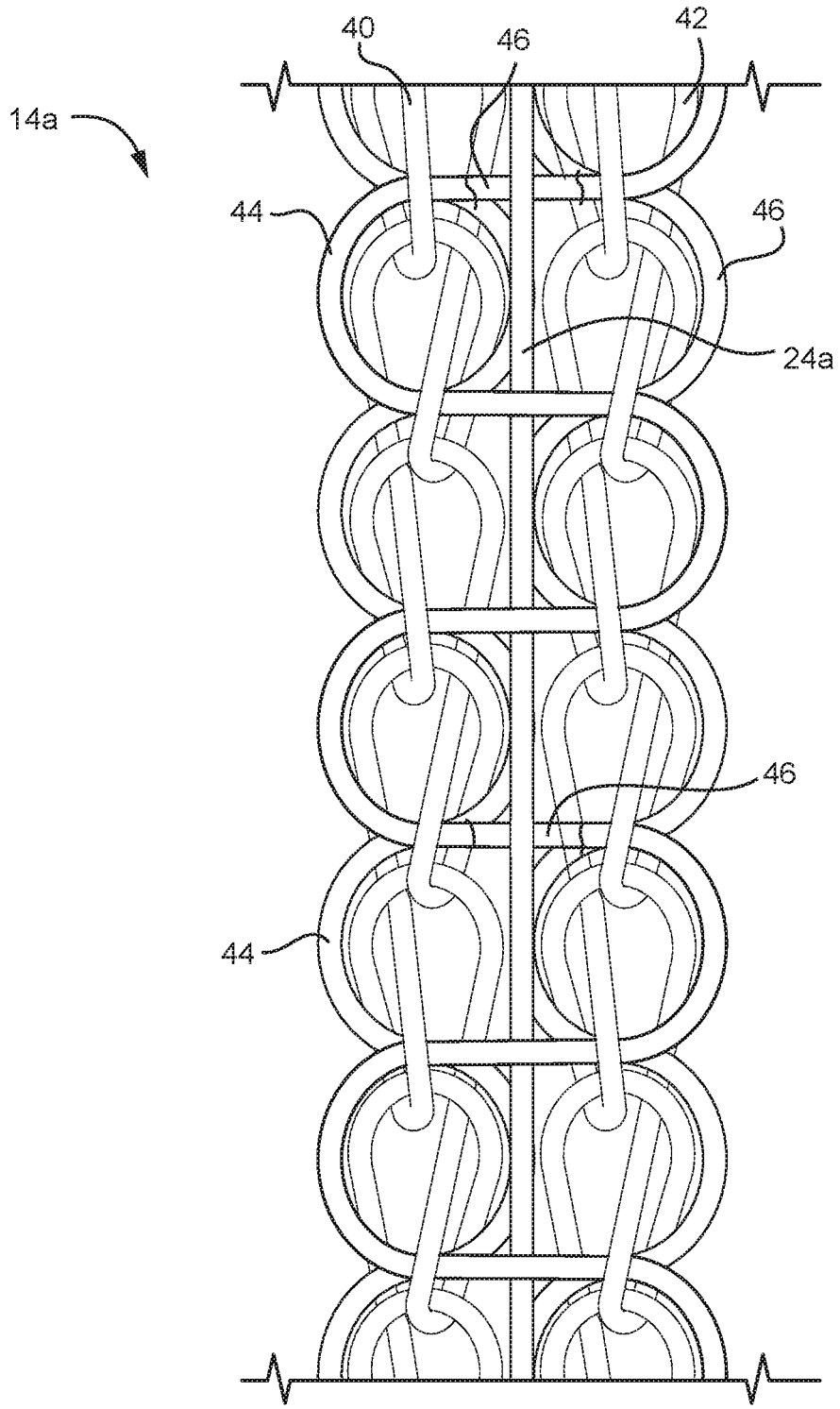
FIG. 3 is a further enlarged schematic view of a knit candle wick that may be employed in the candle wick assembly depicted in FIG. 2.

A representative wick 14*a* is shown in enlarged detail in FIG. 3 in the absence of the ladder filament 32 for clarity of description. It will therefore be understood that the description which follows pertaining to wick 14*a* applies equally to wicks 14*b*-14*d* (or any other wick forming the wick assembly 14). In this regard, the wick 14*a* is a generally flat profile knit wick in accordance with the above-reference U.S. Pat. No. 6,699,034 in that it is formed by two separate warp yarns 40, 42 are knit so as to form parallel side-by-side rows of continuous interlocking loop yarns colloquially known as wales in the art.

The construction of the wick 14*a* shown in FIG. 3 provides for a substantially flat wick structure due to the warp yarns being knit to form parallel side-by-side wales 40, 42 of continuous interlocking loop yarns. The wales 40, 42 are combined to form a single flat knit wick 14*a* by means of at least two additional laid-in or weft-inserted yarns 44, 46 traveling alternately between wales from one loop to another in opposite respective directions. Each such wale 40, 42 formed by the warp yarns 40, 42 is thus knit around a corresponding oppositely oriented laid-in yarn 44, 46, respectively. The oppositely oriented yarns 44, 46 are laid-in, and thus join, the parallel wales 40, 42 one to another. That is, the laid-in yarns 44, 46 travel in opposite back-and-forth or meandering patterns relative to one another and serve to capture therebetween the stiffening element 24*a* which is also positioned between the wales 40, 42.

Each of the yarns 44, 46 is most preferably tensioned in such a way to create a stable wick exhibiting minimal stretch characteristics. The width and/or thickness of the wick 14*a* may be increased or decreased by using larger or smaller yarns or by combining any number of yarns to form the two wales 40, 42. In addition, the size or number of yarns that form the weft or laid-in yarns 44, 46 may be increased or decreased as may be desired. Although not shown in FIG. 3, the ladder filament 32 may be laid in the wales 40, 42 of the wick 14*a* and each of the adjacent wicks 14*b*-14*d* being concurrently knit therewith so as to establish the crossing portions 32*a* as described previously. Those skilled in the art of knitting will realize also that the position and/or number of laid-in yarns could be varied so as to make similar flat profile knit candle wicks.

Due to the construction of the wicks 14*a*-14*d* as described above in reference to FIG. 3, the wicks 14*a*-14*d* will curl in a predetermined direction. Specifically, the warp tensions of the two wales 40, 42 are lower than the weft tensions of the weft-inserted yarns 44, 46 so as to cause the knit candle wick 14*a* to curl in a predetermined direction. That is, as shown in FIG. 3, the visible side of the flat wick 14*a* by virtue of the loop direction is characterized as a "weft side" of the wick 14*a*, whereas the opposite side not shown in FIG. 3 is the "warp side" of the wick 14*a*. The knit structure of the wicks 14*a*-14*d* will therefore cause with wicks when lit to curl toward the weft side thereof, i.e., out of the plane of FIG. 3. It can therefore be understood that when positioning adjacent wicks 14*a*-14*d* in the assembly 14, the wicks will be oriented so that the weft and warp sides of the wicks 14*a*-14*d* alternate relative to one another. In such a manner therefore, the wicks 14*a*-14*d* will be caused to curl in the opposite directions $D_1$ and $D_2$ as shown in FIG. 1.

Various modifications within the skill of those in the art may be envisioned. Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

What is claimed is:

1. A candle which comprises:

a wax body having a bisecting midplane; and a wick assembly positioned in the wax body, wherein the wick assembly comprises:

(i) three or more elongate candle wicks positioned in a parallel spaced apart alignment relative to one another along the bisecting midplane of the wax body, and (ii) a ladder filament connecting the three or more candle wicks to one another, wherein each of the three or more candle wicks is a flat profile knit candle wick comprising:

(a) multiple side-by-side rows of continuous interlocking loops of a knit wick yarn forming respective multiple warp-wise wales having a warp side and a weft side, and (b) at least two weft-inserted yarns traveling alternately between the wales from one of the loops to another in opposite respective directions, wherein warp tensions of the yarns forming the respective warp-wise wales are lower than weft tensions of the at least two weft-inserted yarns so as to cause the candle wick to curl toward the weft side of the candle wick; and wherein each of the three or more candle wicks is positioned in the wax body such that the warp and weft sides thereof alternate with respect to adjacent ones of the candle wicks to allow the candle wicks when lit to curl in opposite outward directions relative to the bisecting midplane and relative to the respective adjacent ones of the candle wicks.

2. The candle according to claim 1, further comprising an anchor tab associated with the wick assembly to anchor the wick assembly.

3. The candle of claim 1, which further comprises a container for the wax body.

4. The candle of claim 1, wherein the respective adjacent ones of the candle wicks curl in opposite orthogonal directions relative to the bisecting midplane of the candle.

5. The candle of claim 4, wherein the candle wick assembly comprises four wicks, wherein adjacent ones of the wicks curl in an opposite orthogonal direction relative to the bisecting midplane of the candle.

6. The candle according to claim 1, wherein the ladder filament includes crossing portions that are substantially orthogonal to respective elongate axes of the candle wicks.

7. The candle according to claim 1, wherein the candle wicks include elongate stiffening elements to impart self-supporting characteristics to the candle wicks.

8. The candle according to claim 1, wherein the ladder filament is a thermoplastic monofilament.

9. The candle according to claim 7, wherein the stiffening elements are selected from the group consisting of thermoplastic monofilaments and spun yarns of natural fibers coated with a thermoplastic material.

10. The candle according to claim 1, wherein the wick yarns comprise fibers selected from the group consisting of spun cotton fibers, rayon fibers, hemp fibers, linen fibers, bamboo fibers and cellulosic fibers.

* * * * *